US008881912B2

(12) United States Patent
Carr

(10) Patent No.: US 8,881,912 B2
(45) Date of Patent: Nov. 11, 2014

(54) INDEPENDENT DECK ADJUSTMENT

(75) Inventor: Brian S. Carr, Burlington, KY (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 12/995,705

(22) PCT Filed: Jun. 4, 2009

(86) PCT No.: PCT/US2009/046271

§ 371 (c)(1),
(2), (4) Date: Dec. 2, 2010

(87) PCT Pub. No.: WO2009/149265

PCT Pub. Date: Dec. 10, 2009

(65) Prior Publication Data

US 2011/0084004 A1 Apr. 14, 2011

Related U.S. Application Data

(60) Provisional application No. 61/059,375, filed on Jun. 6, 2008.

(51) Int. Cl.
*B07B 1/42* (2006.01)
*B07B 1/46* (2006.01)

(52) U.S. Cl.
CPC ..... *B07B 1/42* (2013.01); *B07B 1/4663* (2013.01)
USPC ..... 209/413; 209/260; 209/317; 209/372; 175/66

(58) Field of Classification Search
USPC ..... 209/260, 315, 317, 372, 405, 408, 409, 209/412, 413, 319; 175/66, 206
See application file for complete search history.

(56) References Cited

U.S. PATENT DOCUMENTS

| | | | | | |
|---|---|---|---|---|---|
| 4,082,657 | A | * | 4/1978 | Gage | 209/311 |
| 4,809,791 | A | * | 3/1989 | Hayatdavoudi | 175/40 |
| 5,082,555 | A | * | 1/1992 | Read | 209/244 |
| 5,106,490 | A | * | 4/1992 | McDonald | 209/240 |
| 5,112,474 | A | * | 5/1992 | Douglas | 209/240 |
| 5,156,749 | A | * | 10/1992 | Williams | 210/770 |
| 5,232,098 | A | * | 8/1993 | St-Pierre et al. | 209/240 |
| 5,341,939 | A | * | 8/1994 | Aitchison et al. | 209/319 |

(Continued)

FOREIGN PATENT DOCUMENTS

| | | |
|---|---|---|
| JP | 5-37378 U | 5/1993 |
| JP | 9-192976 A | 7/1997 |
| RU | 2051757 C1 | 1/1996 |

OTHER PUBLICATIONS

BEM-650 Shaker Product Brochure, Published by MI—Swaco, p. 1-8, 2005.*

(Continued)

*Primary Examiner* — Joseph C Rodriguez
(74) *Attorney, Agent, or Firm* — Osha Liang LLP

(57) ABSTRACT

A vibratory separator including a separator deck including a hinge point, and a positive displacement mechanism coupled to the separator deck and configured to displace the separator deck to an angle of inclination is disclosed. A method of separating solids form a slurry, the method including pumping a slurry onto a separator deck, vibrating the separator deck, and displacing an end of the separator deck in an upwards or downwards direction with a positive displacement mechanism to a selected angle of inclination is also disclosed.

19 Claims, 3 Drawing Sheets

(56) References Cited

U.S. PATENT DOCUMENTS

| | | | | |
|---|---|---|---|---|
| 5,501,343 | A * | 3/1996 | Hadden | 209/240 |
| 5,544,762 | A * | 8/1996 | Liimatainen et al. | 209/675 |
| 7,571,817 | B2 * | 8/2009 | Scott et al. | 209/413 |
| 8,631,945 | B1 * | 1/2014 | Cato | 209/274 |
| 2006/0243643 | A1 | 11/2006 | Scott et al. | |
| 2007/0068852 | A1 | 3/2007 | Lease et al. | |
| 2008/0093269 | A1 * | 4/2008 | Timmerman et al. | 209/405 |
| 2008/0283301 | A1 * | 11/2008 | Sherwood et al. | 175/206 |

OTHER PUBLICATIONS

International Search Report from PCT/US2009/046271 dated Jan. 13, 2010 (2 pages).

Written Opinion from PCT/US2009/046271 dated Jan. 13, 2010 (3 pages).

Examination Report issued in corresponding Canadian Application No. 2,727,145; Dated Mar. 28, 2012 (3 pages).

Office Action issued in corresponding Chinese Application No. 200980128892.0; Dated Apr. 2, 2013 (12 pages).

Official Action issued in corresponding Eurasian Application No. 201071401 along with English language communication reporting the same; Dated Feb. 22, 2013 (4 pages).

Office Action issued in corresponding Chinese Application No. 200980128892.0 dated Sep. 24, 2013 (14 pages).

Official Action issued in corresponding Eurasian Application No. 201071401 along with English language communication reporting the same; Dated Oct. 22, 2013 (4 pages).

Office Action issued in corresponding Chinese Application No. 200980128892.0; Dated Jul. 20, 2012 (9 pages).

Official Action issued in corresponding Eurasian Application No. 201071401 along with English language communication reporting the same; Dated Sep. 17, 2012 (5 pages).

Official Action issued in corresponding Mexican Application No. MX/a/2010/013225 with English correspondence reporting the same; Dated Jul. 22, 2013 (7 pages).

Official Action issued in corresponding Mexican Application No. MX/a/2010/013225 with English correspondence reporting the same; Dated Jun. 12, 2014 (7 pages).

Office Action issued in corresponding Chinese Application No. 200980128892.0 dated Mar. 17, 2014 (18 pages).

Official Action issued in corresponding Mexican Application No. MX/a/2010/013225 with English correspondence reporting the same; Dated Jan. 31, 2014 (4 pages).

Official Action issued in corresponding Eurasian Application No. 201071401/31 along with English language communication reporting the same; dated May 20, 2014 (9 pages).

* cited by examiner

INDEPENDENT DECK ADJUSTMENT

BACKGROUND

1. Field of Disclosure

Embodiments disclosed herein relate generally to apparatus and methods for increasing the efficiency of vibratory separator. Specifically, the present disclosure relates to a separator deck for separating drill cuttings from a return drilling fluid.

2. Background Art

Oilfield drilling fluid, often called "mud," serves multiple purposes in the industry. Among its many functions, the drilling mud acts as a lubricant to cool rotary drill bits and facilitate faster cutting rates. Typically, the mud is mixed at the surface and pumped downhole at high pressure to the drill bit through a bore of the drillstring. Once the mud reaches the drill bit, it exits through various nozzles and ports where it lubricates and cools the drill bit. After exiting through the nozzles, the "spent" fluid returns to the surface through an annulus formed between the drillstring and the drilled wellbore.

Furthermore, drilling mud provides a column of hydrostatic pressure, or head, to prevent "blow out" of the well being drilled. This hydrostatic pressure offsets formation pressures, thereby preventing fluids from blowing out if pressurized deposits in the formation are breached. Two factors contributing to the hydrostatic pressure of the drilling mud column are the height (or depth) of the column (i.e., the vertical distance from the surface to the bottom of the wellbore) itself and the density (or its inverse, specific gravity) of the fluid used. Depending on the type and construction of the formation to be drilled, various weighting and lubrication agents are mixed into the drilling mud to obtain the right mixture. Typically, drilling mud weight is reported in "pounds," short for pounds per gallon. Generally, increasing the amount of weighting agent solute dissolved in the mud base will create a heavier drilling mud. Drilling mud that is too light may not protect the formation from blow outs, and drilling mud that is too heavy may over invade the formation. Therefore, much time and consideration is spent to ensure the mud mixture is optimal. Because the mud evaluation and mixture process is time consuming and expensive, drillers and service companies prefer to reclaim the returned drilling mud and recycle it for continued use.

Another significant purpose of the drilling mud is to carry the cuttings away from the drill bit at the bottom of the borehole to the surface. As a drill bit pulverizes or scrapes the rock formation at the bottom of the borehole, small pieces of solid material are left behind. The drilling fluid exiting the nozzles at the bit acts to stir-up and carry the solid particles of rock and formation to the surface within the annulus between the drillstring and the borehole. Therefore, the fluid exiting the borehole from the annulus is a slurry of formation cuttings in drilling fluid. Before the fluid can be recycled and repumped down through nozzles of the drill bit, the cuttings must be removed.

Apparatus in use today to remove cuttings from drilling fluid are commonly referred to in the industry as shale shakers or vibratory separators. A vibratory separator is a vibrating sieve-like table upon which returning solids laden drilling fluid is deposited and through which clean drilling fluid emerges. Typically, the vibratory separator is an angled table with a generally perforated filter screen bottom. Returning drilling fluid is deposited at the feed end of the vibratory separator, where it is deposited on to a vibrating table, also known as deck. As the drilling fluid travels down the length of the vibrating table, the fluid falls through the perforations to a reservoir below, leaving the cuttings or solid particulates behind. The vibrating action of the vibratory separator table conveys cuttings left behind to a discharge end of the separator table.

Accordingly, there exists a need for a separator that may more efficiently remove cuttings from a return drilling fluid.

SUMMARY OF INVENTION

In one aspect, embodiments disclosed herein relate to a vibratory separator including a separator deck including a hinge point, and a positive displacement mechanism coupled to the separator deck and configured to displace the separator deck to an angle of inclination.

In another aspect, embodiments disclosed herein relate to a vibratory separator including a plurality of separator decks, wherein at least one separator deck includes a hinge point, and at least one positive displacement mechanism coupled to at least one separator deck including a hinge point to displace the at least one separator deck including a hinge point to an angle of inclination.

In yet another aspect, embodiments disclosed herein relate to a method of separating solids form a slurry, the method including pumping a slurry onto a separator deck, vibrating the separator deck, and displacing an end of the separator deck in an upwards or downwards direction with a positive displacement mechanism to a selected angle of inclination.

DETAILED DESCRIPTION

In one aspect, embodiments disclosed herein relate generally to apparatuses and methods for separating cuttings from a return drilling fluid. More specifically, embodiments disclosed herein relate to a vibratory separator that uses a device to control the displacement of a separator deck upwards or downwards, thereby increasing the efficiency of the separator. In certain embodiments, a positive displacement mechanism may be used to control the movement of an end of a separator deck upwards or downwards.

Typically, drilling fluids used in drilling operations return from a wellbore as a slurry, which includes a liquid phase with a solid phase entrained therein. The liquid phase may include drilling fluid, chemicals, and water, while the solid phase may include drill cuttings. As used herein, "drill cuttings" or "cuttings" refer to solids, for example, earth formations removed from a wellbore while drilling. Upon return, the slurry may undergo any number of separation techniques (e.g., centrifugation, thermal desorption, and screening) to separate the cuttings from the slurry. Once the cuttings have been separated, the cuttings are discharged from a separator and transferred to a storage vessel, where they may be stored for eventual removal from the drill site.

Figure 1:
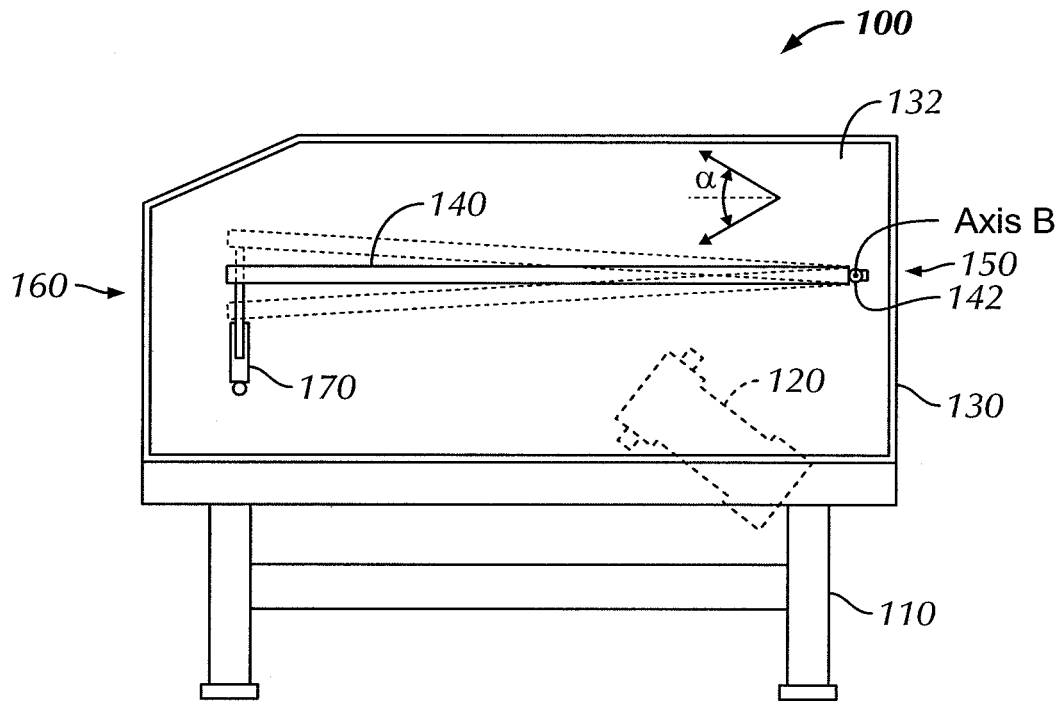
FIG. 1 shows a vibratory separator in accordance with an embodiment of the present disclosure.

Referring to FIG. 1, a vibratory separator 100 in accordance with an embodiment of the present disclosure is shown. The vibratory separator 100 includes a base 110, a motor 120, a basket 130, a separator deck 140, a receiving end 150, a discharge end 160, and a positive displacement mechanism 170. A screening device (not shown) is disposed on the separator deck 140. During operation, the vibratory separator 100 is configured to receive a slurry (e.g., return drilling fluid) including a liquid phase (e.g., drilling fluid) with a solid phase (e.g., drill cuttings) entrained therein. Typically, the screening device includes one or more filtering elements having sized perforations for separating the solid phase from the liquid phase. Once the solid phase is separated from the liquid phase, the solid phase may be discharged from the vibratory separator 100 and disposed of properly.

The base 110 is configured to support the basket 130, and may be coupled to the basket 130 through a spring (not shown) or any other component that allows the basket 130 to be vibrated in a particular motion. In certain embodiment, the base 110 may also be attached to a fixed structure (not shown) that will allow the base 110 to maintain a certain position while operating the vibratory separator 100.

The motor 120 is typically coupled to the basket 130 and configured to vibrate the basket 130 and separator deck 140 in various types of motion. These types of motion may include balanced/unbalanced elliptical, linear, circular, or any other type of motion known in the art. However, in certain embodiments, the motor 120 may also be coupled to the base 110 and still used to transfer motion to the basket 130. Further, in an alternate embodiment, the separator 100 may include a plurality of motors that are configured to vibrate the basket 130 and separator deck 140 in multiple types of motions simultaneously. Examples of such motion may be found in U.S. patent application Ser. No. 11/861,940, which is herein incorporated by reference.

Moreover, the basket 130 includes sidewalls 132 that are configured to guide cuttings separated by the separator 100 from the receiving end 150 to the discharge end 160 of the separator 100. In one embodiment, the sidewalls 132 may include seals (not shown) that provide a seal between the sidewalls 132 and the separator deck 140, thereby preventing or reducing cuttings or drilling fluid from flowing between the separator deck 140 and the side walls 132 (i.e., bypassing the screening device).

Furthermore, the separator deck 140 is coupled to the basket 130 through a hinge point 142 and is configured to be vibrated by the motor 120. The screening device is disposed on the separator deck 140 includes a screen (not shown) configured to separate drill cuttings from a slurry. Screens typically include filtering elements (not illustrated) attached to a screen frame (not shown). The filtering elements define the largest solid particle capable of passing therethrough. Additionally, at least one positive displacement mechanism 170 is coupled to the basket 130 and configured to move the separator deck 140. In this embodiment, the positive displacement mechanism 170 is disposed near the discharge end 160 of the vibratory separator 100. However, in an alternate embodiment, the positive displacement mechanism 170 may be disposed near the receiving end 150, or any other location that allows the separator deck 140 to be moved.

In one embodiment, the hinge point 142 is positioned proximal the receiving end 150 and configured to allow the separator deck 140 to be rotated about an axis B. As such, the hinge point 142 provides an angle of inclination $\alpha$ of the separator deck 140 that may be varied during operation. While angle "$\alpha$" is referred to herein as an angle of inclination, one of ordinary skill in the art will appreciate that angle "$\alpha$" also refers to an angle of declination. The angle of inclination $\alpha$ refers to the angle formed between the separator deck 140 and a horizontal plane. One skilled in the art will appreciate that various angles of inclination $\alpha$ may be used while separating cuttings from a slurry. For example, the angle of inclination $\alpha$ may be within the range of ±30 degrees, ±15 degrees, or ±5 degrees while separating cuttings from a slurry.

Figure 2:
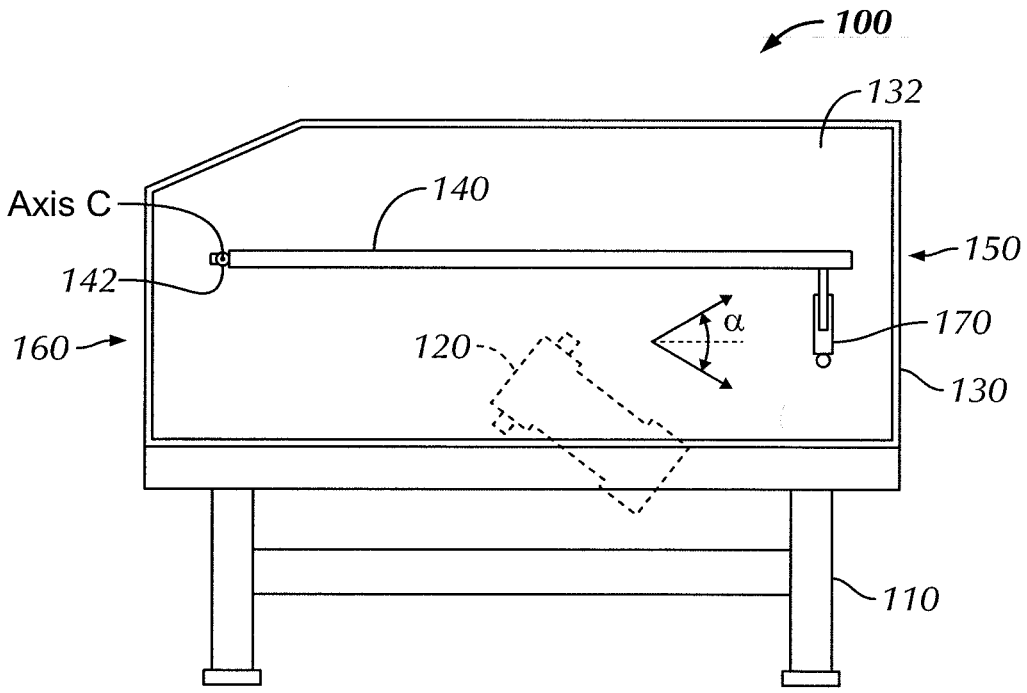
FIG. 2 shows a vibratory separator in accordance with an embodiment of the present disclosure.

Referring now to FIG. 2, in an alternate embodiment the hinge point 142 is positioned proximal the discharge end 160 and configured to rotate around axis C. This may allow the positive displacement mechanism 170 to be disposed near the receiving end 150. Accordingly, the end of the separator deck 140 near the receiving end 150 may be displaced upwards or downwards. This may be necessary in certain instances where there is an inadequate amount of space for the positive displacement mechanism 170 to be disposed towards the discharge end 160 of the separator 100. In this embodiment, the angle of inclination $\alpha$ is the angle formed between the separator deck 140 and a horizontal plane. The angle of inclination $\alpha$ may be within the range of ±30 degrees, ±15 degrees, or ±5 degrees while separating cuttings from a slurry.

Figure 4:
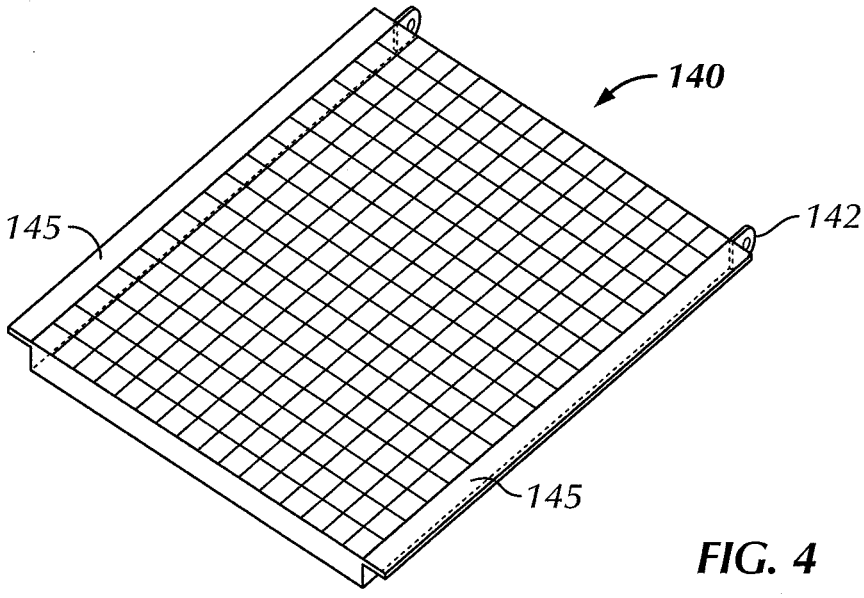
FIG. 4 shows a component view of a separator deck in accordance with an embodiment of the present disclosure.

Referring now to FIGS. 1 and 4, in select embodiments, the separator deck 140 may further include a seal 145 disposed on the outer edge of the separator deck 140 and configured to form a seal between the separator deck 140 and the sidewalls 132 of the basket 130. One skilled in the art will appreciate that the seal 145 may prevent or reduce cuttings or drilling fluid from flowing between the separator deck 140 and the side walls 132 during operation (i.e., bypassing the screening device).

Figure 3:
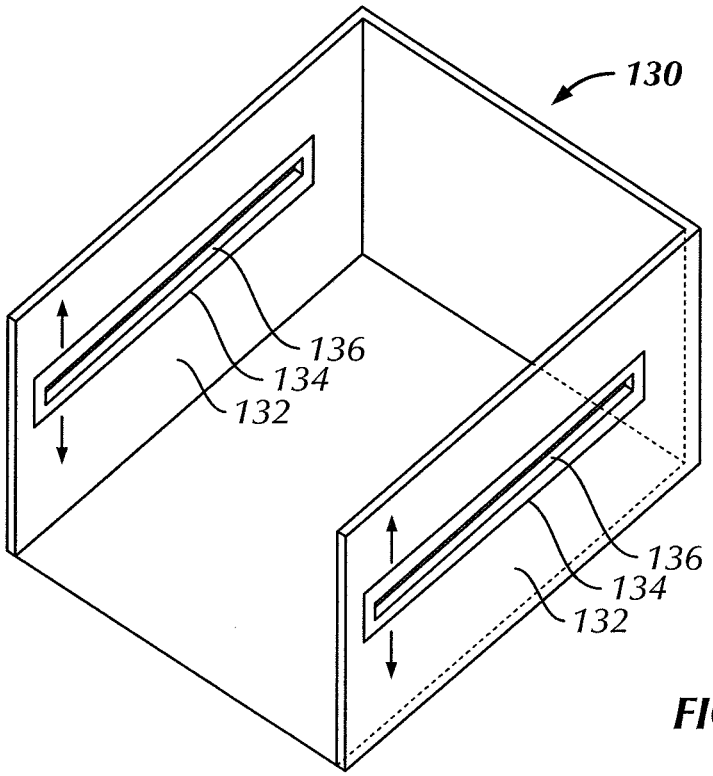
FIG. 3 shows a component view of a basket in accordance with an embodiment of the present disclosure.

Referring now to FIGS. 1 and 3, in select embodiments, the basket 130 may further include moveable walls 136. The moveable walls 136 are coupled to the side walls 132 in such a way that they can be translated with the separator deck 140. For example, the moveable walls 136 may be coupled to the side walls 132 of the basket 130 through at least one bearing (not shown) or any other attachment feature that allows the moveable walls 136 to move in the same direction as the separator deck 140, as the separator deck 140 is vibrated. Further, as shown, the moveable walls 136 may include seals 134 that are configured to form a seal between the sidewalls 132 and the separator deck 140. Thus, in this embodiment, a seal is maintained between the sidewalls and the separator deck 140 during operation.

Referring back to FIG. 1, the positive displacement mechanism 170 is configured to control the displacement of the separator deck 140 in an upwards and/or downwards direction. In one embodiment, the positive displacement mechanism 170 is coupled to the separator deck 140 and the basket 130 near the discharge end 160 of the separator 100. As the separator deck 140 is displaced, the separator deck 140 rotates around axis B, thereby changing the angle of inclination $\alpha$. Consequently, the positive displacement mechanism 170 is used to control the angle of inclination $\alpha$ of the separator deck 140. One skilled in the art will appreciate that the positive displacement mechanism 170 may include mechanical springs, air springs, shocks, actuators or any other positive displacement mechanism known in the art.

In select embodiments, the positive displacement mechanism 170 may include an actuator that is actuated using a pressurized fluid, such as hydraulic fluid. For example, a pressurized hydraulic fluid may be pumped into to the actuator, thereby extending a piston of the actuator and causing the separator deck 140 to be displaced upwards or downwards.

Further, a pressurized hydraulic fluid may be released from the actuator, thereby retracting the piston of the actuator and also causing the separator deck 140 to be displaced. In certain embodiments, the actuator may be operatively connected to a controller (not shown) configured to control the flow of the pressurized fluid pumped into and released out of the actuator.

In select embodiments, the positive displacement mechanism 170 may include at least one air bellow. In one embodiment, the air bellow may be disposed below the separator deck 140. As slurry is pumped onto the separator deck 140, the weight of the slurry may cause air within the air bellow to be compressed. As a result, the air bellow may compress and allow the separator deck 140 to move downward, thereby changing the angle of inclination α. Furthermore, when the weight of slurry on the separator deck 140 is reduced, the air bellow may extend upwards, thereby changing the angle of inclination α. In another embodiment, the air bellow may be disposed above the separator deck 140. As slurry is pumped onto the separator deck 140, the weight of the slurry may cause the air bellow to extend downwards. Moreover, when the weight of the slurry on the separator deck 140 is reduced, the air bellow may compress upwards.

In select embodiments, the air bellow may include a valve that controls the pressure of the air inside the air bellow. The valve may permit the pressure of the air inside the air bellow to be increased, which may increase the amount of force (i.e., weight) required to compress or extend the air bellow. Alternatively, the valve may permit the pressure of the air inside the air bellow to be decreased, which may decrease the force required to compress or extend the air bellow.

When the slurry is pumped from a wellbore to the separator 100. The slurry is typically pumped onto the separator deck 140 at a certain flow rate. This flow rate may be controlled by a flow control valve, for example, a globe valve, ball valve, or any other flow control device known in the art. While the slurry is pumped onto the separator deck 140, the motor 120 vibrates the basket 130 and the separator deck 140, thereby causing the cuttings to be separated from the slurry. The drilling fluids and solid particulates pass through the screen of the separator deck 140 and are recovered below.

Further, the cuttings that are separated from the slurry may migrate across the separator deck 140 to the discharge end 160 of the separator 100. These cuttings may migrate across the screen at a certain rate. During operation, the angle of inclination α of the separator deck 140 may be used to control the rate at which the cuttings migrate across the separator deck 140. For example, when the hinge point 142 is disposed near the receiving end 150 and the angle of inclination α of the separator deck 140 is −10 degrees, the separator deck 140 will create a pathway that is sloped downward towards the discharge end 160. This downward sloping deck may increase the rate at which the cuttings migrate across the separator deck 140. In contrast, when the angle of inclination α is +10 degrees, the separator deck 140 will create a pathway that is sloped upwards towards the discharge end 160, which may decrease the rate at which the cuttings migrate across the separator deck 140. Accordingly, the rate at which the cuttings migrate across the separator deck may be proportional to the angle of inclination α.

One skilled in the art will appreciate that the control and adjustment of the angle of inclination α may be helpful during operation. For example, a large amount of the cuttings may build up on the separator deck 140, thereby reducing the efficiency of the separator 100. Such a build up may be caused by an increase in the flow rate of the slurry pumped onto the separator deck 140, a change in the formation being drilled, or any other conditions known in the art. Correspondingly, the angle of inclination α may be decreased to increase the rate at which the cuttings migrate across the separator deck 140, which may keep the cuttings from building up on the separator deck 140.

The angle of inclination α is controlled by the positive displacement mechanism 170. For example, the positive displacement mechanism 170 may compress to rotate the separator deck 140 downwards, thereby changing the angle of inclination α. Alternatively, the positive displacement mechanism 170 may extend upwards to rotate the separator deck 140 upwards, thereby changing the angle of inclination α. Once the cuttings reach the discharge end 160, the cuttings are discharged from the separator 100 and usually transferred to another location.

Figure 5:
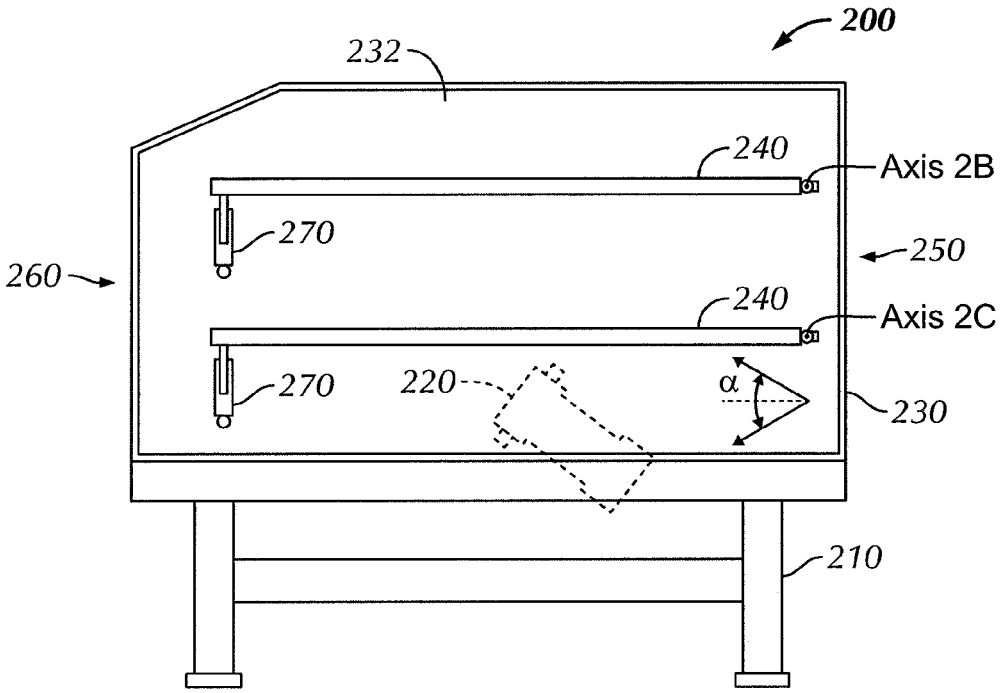
FIG. 5 shows a vibratory separator in accordance with an embodiment of the present disclosure.

Referring now to FIG. 5, a vibratory separator 200 in accordance with an embodiment of the present disclosure is shown. Similar to the vibratory separator 100, the vibratory separator 200 includes a base 210, a motor 220, a basket 230, a receiving end 250, and a discharge end 260. However, the vibratory separator 200 further includes a plurality of separator decks 240 and a plurality of positive displacement mechanisms 270.

As shown, each of the separator decks 240 includes a hinge point 242 that allows each of the separator decks 240 to rotate around an axis 2B, 2C. As such, each of the separator decks 240 may be rotated to an angle of inclination 247. One skilled in the art will appreciate that the use of multiple separator decks 240 may allow various sized cuttings to be separated by a screen on each separator deck 240. Accordingly, this may allow the separator 200 to more efficiently separate cuttings from a slurry.

Further, as depicted, the separator decks 240 are coupled to the plurality of positive displacement mechanisms 270. Similar to the positive displacement mechanism 170 shown in FIG. 1, the positive displacement mechanisms 270 are coupled to the sidewalls 232 of the basket 230 and configured to control the displacement of each separator deck 240 in an upwards or downwards direction. The plurality of positive displacement mechanisms 270 may allow each separator deck 240 to have a different angle of inclination 247. For example, one separator deck may have a +30 degree angle of inclination, while another separator deck may have a −30 degree angle of inclination.

During operation of separator 200, a slurry is deposited on the top of the highest separator deck 240, near the receiving end 250 of the separator 200. The slurry is pumped from a wellbore to the separator 200. As previously discussed, the slurry is typically pumped onto the separator deck 240 at a certain flow rate. While the slurry is pumped onto the highest separator deck 240, the motor 220 vibrates the basket 230 and the separator decks 240, thereby causing cuttings to be separated from the slurry as the slurry passes through each of the separator decks 240. The drilling fluids and solid particulates pass through the filtering elements of each of the separator decks 240 and are recovered below.

Additionally, during operation the positive displacement mechanisms 270 may control the angle of inclination 247 of each of the separator decks 240, similar to positive displacement mechanism 170 shown in FIG. 1. Thus, the cuttings may migrate across each separator deck 240 at different rates, thereby increasing the efficiency of the separator 200.

Figure 6:
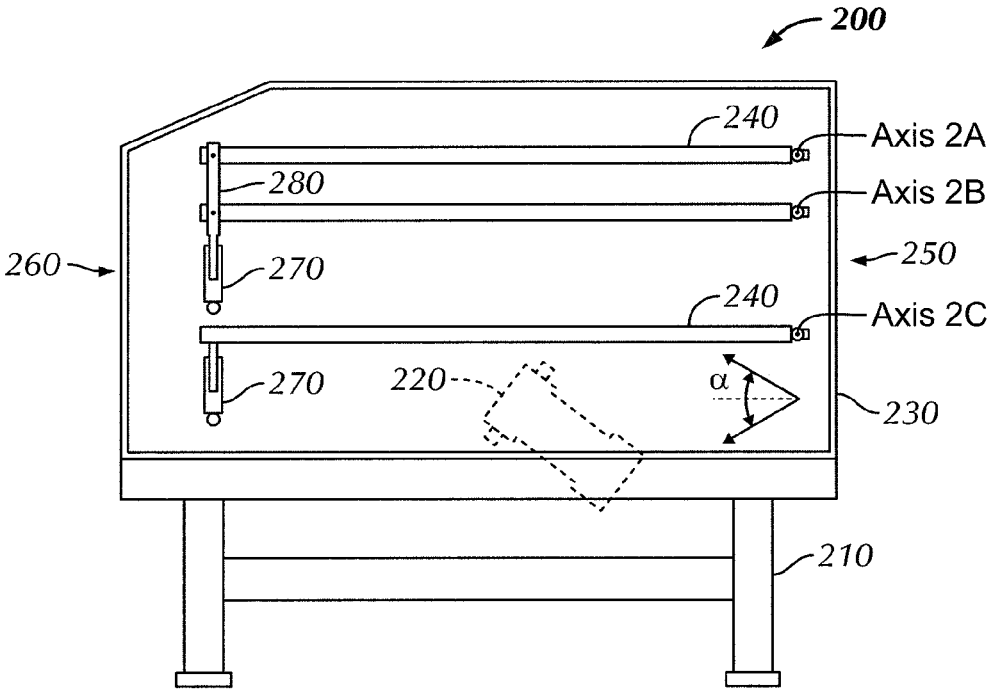
FIG. 6 shows a vibratory separator in accordance with an embodiment of the present disclosure.

Referring now to FIG. 6, in select embodiments, at least two of the plurality of separator decks 240 may be coupled to the same positive displacement mechanism 270. The at least two of the plurality of separator decks 240 may be coupled to the same positive displacement mechanism 270 through a connection 280. The connection 280 may include a bracket, support member, or other any other coupling device known in the art. One skilled in the art will appreciate that connection 280 may enable a movement from at least one positive displacement mechanism 270 to be translated to more than one separator deck 240.

Embodiments of the present disclosure may include one or more of the following advantages. A separator deck capable of being rotated about an axis during operation. A device (e.g., a positive displacement mechanism) that can control the angle of inclination of at least one separator deck during operations. A vibratory separator that can more efficiently separate cuttings from a slurry.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A vibratory separator comprising:

a basket including sidewalls;

a separator deck including a hinge point;

at least one seal disposed between the sidewalls of the basket and the separator deck and configured to seal the separator deck to the sidewalls of the basket; and a positive displacement mechanism coupled to the separator deck and configured to displace the separator deck to an angle of inclination, wherein the angle of inclination of the separator deck is varied with a rate of cuttings migration across the separator deck.

2. The vibratory separator of claim 1, wherein a portion of the sidewalls of the basket are configured to move when the separator deck is displaced.

3. The vibratory separator of claim 1, wherein the hinge point is disposed proximate one of a discharge end and a receiving end of the vibratory separator.

4. The vibratory separator of claim 1, wherein the angle of inclination is in the range of one of ±5 degrees, ±15 degrees, and ±30 degrees.

5. The vibratory separator of claim 1, wherein the positive displacement mechanism comprises one of a group consisting of an actuator, a spring, and an air bellow.

6. The vibratory separator of claim 1, wherein the separator deck is oscillated in a motion, wherein the motion comprises at least one of a group consisting of linear, elliptical, and circular.

7. The vibratory separator of claim 1, wherein the angle of inclination of the separator deck is varied in relation to the weight of a slurry pumped onto the separator deck.

8. The vibratory separator of claim 7, wherein the positive displacement mechanism is an air bellow.

9. A vibratory separator comprising:

a basket with sidewalls;

a plurality of separator decks, wherein the plurality of separator decks include respective hinge points; and at least one positive displacement mechanism coupled to at least two of the plurality of separator decks and configured to displace the at at least two of the plurality of separator decks about the respective hinge point to an angle of inclination.

10. The vibratory separator of claim 9, wherein the angle of inclination is in the range of ±30 degrees.

11. The vibratory separator of claim 9, wherein the at least one positive displacement mechanism comprises at least one of a group consisting of an actuator, a spring, and an air bellow.

12. The vibratory separator of claim 9, wherein the positive displacement mechanism is coupled to two separator decks of the plurality of separator decks.

13. The vibratory separator of claim 9, further comprising a second positive displacement mechanism, wherein the second positive displacement mechanism is coupled to another of the plurality of separator decks.

14. A method of separating solids from a slurry, the method comprising:

pumping a slurry onto a separator deck;

guiding the slurry along the separator deck, the separator deck sealed to the sidewalls of the basket to prevent slurry from bypassing the separator deck;

vibrating the separator deck; and displacing an end of the separator deck in an upwards or downwards direction with a positive displacement mechanism coupled to the separator deck to a selected angle of inclination based on a rate of cuttings migration across a separator deck.

15. The method of claim 14, wherein the displacing comprises actuating the positive displacement mechanism to displace the end of the separator deck.

16. The method of claim 15, wherein actuating the positive displacement mechanism includes depressurizing a fluid within the positive displacement mechanism.

17. The method of claim 15, wherein actuating the positive displacement mechanism includes pressurizing a fluid within the positive displacement mechanism.

18. The method of claim 14, the method further comprising:

determining a flow rate of a slurry pumped onto the separator deck; and adjusting the angle of inclination of the separator deck based on the determined flow rate to optimize the separation of cuttings from the slurry.

19. The method of claim 14, wherein displacing comprises rotating the separator deck about a hinge point disposed proximate a discharge or receiving end of the vibratory separator.

* * * * *